US006432596B2

(12) United States Patent
Ikuno et al.

(10) Patent No.: US 6,432,596 B2
(45) Date of Patent: Aug. 13, 2002

(54) ELECTROPHOTOGRAPHIC PHOTORECEPTOR AND IMAGE FORMING METHOD AND APPARATUS USING THE PHOTORECEPTOR

(75) Inventors: Hiroshi Ikuno, Kanagawa-ken; Narihito Kojima; Eiji Kurimoto, both of Shizuoka-ken, all of (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 09/824,687

(22) Filed: Apr. 4, 2001

(30) Foreign Application Priority Data

Apr. 5, 2000 (JP) ..... 2000-103888
Feb. 22, 2001 (JP) ..... 2001-047211

(51) Int. Cl.[7] ..... G03G 5/14
(52) U.S. Cl. ..... 430/58.05; 430/66; 430/97; 399/159
(58) Field of Search ..... 430/97, 58.05; 399/159, 66

(56) References Cited

U.S. PATENT DOCUMENTS

| | | | | |
|---|---|---|---|---|
| 5,008,168 A | * | 4/1991 | Nakagawa et al. | 430/58.05 |
| 5,308,727 A | * | 5/1994 | Osawa et al. | 430/58.05 |
| 5,578,405 A | | 11/1996 | Ikegami et al. | 430/59 |
| 5,871,876 A | | 2/1999 | Ikuno et al. | 430/59 |
| 6,030,733 A | | 2/2000 | Kami et al. | 430/56 |
| 6,151,468 A | | 11/2000 | Kami et al. | 430/56 |

FOREIGN PATENT DOCUMENTS

| | | |
|---|---|---|
| DE | 40 20 620 | 1/1991 |
| DE | 196 26 806 | 1/1997 |
| JP | 50-33857 | 11/1975 |
| JP | 51-34736 | 9/1976 |
| JP | 56-130759 | 10/1981 |
| JP | 57-122444 | 7/1982 |
| JP | 60-213953 | 10/1985 |
| JP | 62-105151 | 5/1987 |
| JP | 01-200261 | 8/1989 |
| JP | 03-278061 | 12/1991 |
| JP | 05-289389 | 11/1993 |
| KR | 9 402 117 | 3/1994 |

* cited by examiner

*Primary Examiner*—John Goodrow
(74) *Attorney, Agent, or Firm*—Oblon, Spivak, McClelland, Maier & Neustadt, P.C.

(57) ABSTRACT

An electrophotographic photoreceptor including an electroconductive substrate; a charge generation layer overlying the substrate; a charge transport layer formed overlying the substrate and including a charge transport material, a polycarbonate resin, an antioxidant having the following formula (1):

(1)

and a sulfur-containing compound having an alkyl group having from 6 to 30 carbon atoms; and a protective layer comprising a binder resin and a filler dispersed in the binder resin and formed as a top layer.

30 Claims, 2 Drawing Sheets

ELECTROPHOTOGRAPHIC PHOTORECEPTOR AND IMAGE FORMING METHOD AND APPARATUS USING THE PHOTORECEPTOR

BACKGROUND OF THE INVENTION

1. Field of the Invention

The present invention relates to an electrophotographic photoreceptor. In addition, the present invention relates to an image forming method and apparatus using a photoreceptor.

2. Discussion of the Background

The following photosensitive layers have been used for electrophotography photoreceptors:

(1) layers mainly constituted on selenium or a selenium alloy;
(2) layers in which an inorganic photocoductive material such as zinc oxide or cadmium sulfide is dispersed in a binder resin;
(3) layers using an organic photoconductive material such as a combination of poly-N-vinylcarbazole and trinitrofluorenone, and azo pigments; and
(4) layers using amorphous silicon.

The electrophotographic image forming methods typically include the following processes:

(1) charging an electrophotographic photoreceptor in a dark place (charging process);
(2) irradiating the charged photoreceptor with imagewise light to form an electrostatic latent image thereon (light irradiating process);
(3) developing the latent image with a developer including a toner mainly constituted of a colorant and a binder to form a toner image thereon (developing process);
(4) optionally transferring the toner image on an intermediate transfer medium (first transfer process);
(5) transferring the toner image onto a receiving material such as a receiving paper ((second) transfer process);
(6) heating the toner image to fix the toner image on the receiving material (fixing process); and
(7) cleaning the surface of the photoreceptor (cleaning process).

In such image forming methods, requisites for the photoreceptors are as follows:

(1) to be able to be charged so as to have a proper potential in a dark place;
(2) having a high charge retainability (i.e., the charge formed thereon hardly decays in a dark place); and
(3) to rapidly decay the charge thereon upon application of light thereto.

Currently, the photoreceptors using organic photosensitive materials are widely used because of satisfying such requisites as mentioned above and having the following advantages over the other photoreceptors:

(1) manufacturing costs are relatively low;
(2) having good designing flexibility (i.e., it is easy to design a photoreceptor having a desired property); and
(3) hardly causing environmental pollution.

As for the organic photoreceptors, the following photosensitive layers are known:

(1) a photosensitive layer including a photoconductive resin such as polyvinyl carbaozole (PVK) or the like material;
(2) a charge transfer photosensitive layer including a charge transfer complex such as a combination of polyvinyl carbaozole (PVK) and 2,4,7-trinitrofluorenone (TNF) or the like material;
(3) a photosensitive layer in which a pigment, such as phthalocyanine or the like, is dispersed in a binder resin; and (4) a functionally-separated photosensitive layer including a charge generation material and a charge transport material.

Among these organic photoreceptors, the photoreceptors having a functionally-separated photosensitive layer especially attract attention now.

The mechanism of forming an electrostatic latent image in the functionally-separated photosensitive layer having a charge generation layer and a charge transport layer formed on the charge generation layer is as follows:

(1) when the photosensitive layer is exposed to light after being charged, light passes through the transparent charge transport layer and then reaches the charge generation layer;
(2) the charge generation material included in the charge generation layer absorbs the light and generates a charge carrier such as electrons and positive holes;
(3) the charge carrier is injected to the charge transport layer and transported through the charge transport layer due to the electric field formed by the charge on the photosensitive layer;
(4) the charge carrier finally reaches the surface of the photosensitive layer and neutralizes the charge thereon, resulting in formation of an electrostatic latent image.

For such functionally-separated photoreceptors, a combination of a charge transport material mainly absorbing ultraviolet light and a charge generation material mainly absorbing visible light is effective and is typically used. Thus, functionally-separated photoreceptors satisfying the requisites as mentioned above can be prepared.

Currently, needs such as high speed recording, high durability and upsizing are growing for electrophotographic image forming apparatus. Therefore, an increasing need exists for photoreceptors having high reliability, which can produce good images even when repeatedly used for a long period of time while having the above-mentioned requisites.

In general, photoreceptors have a drawback such that when the photoreceptors are repeatedly used in image forming apparatus, the potentials of the dark and lighted areas serious vary. One reason for such variation in the electrostatic properties is abrasion of the photosensitive layer. Currently, photoreceptors are used for a long period of time for the reasons mentioned above, and therefore the surface of the photoreceptors tends to be abraded, resulting in deterioration of the above-mentioned electrostatic properties. Therefore, photoreceptors having good mechanical durability have been investigated. On the other hand, various measures to reduce the abrasion of a photoreceptor have been investigated at the image forming apparatus side.

Another reason for the variation in the electrostatic properties of photoreceptors is that the materials used in the photosensitive layer are chemically deteriorated by the substances generated in image forming apparatus, such as ozone and nitrogen oxides (NOx). In particular, it is a serious problem that when the surface potential of a photoreceptor is decreased due to such substances, the image qualities of the resultant images deteriorate.

In attempting to prevent such decrease of surface potential of photoreceptors, methods in which an additive having an anti-oxidation function is included in charge transport layer thereof have been disclosed in Japanese Patent Publications Nos. 50-33857 and 51-34736, and Japanese Laid-Open Patent Publications Nos. 56-130759, 57-122444, 62-105151 and 3-278061.

However, it is found by the present inventors' investigation that such methods have a drawback such that the potential in a lighted area increases.

On the other hand, halogen-containing solvents such as monochlorobenzene, dichloromethane and the like, which are typically used for coating charge transport layers, are considered to adversely affect the natural environment and human being. In order to protect environment, it is needed that halogen-containing solvents are not used when charge transport layers are formed.

Halogen-containing solvents are used in charge transport layer coating liquids to dissolve a polycarbonate resin which is typically used as a binder resin in charge transport layers. Tetrahydrofuran, dioxane, xylene, toluene, methyl ethyl ketone, cyclohexanone etc. can be used as a substitute for halogen-containing solvents. Among these substitutes, tetrahydrofuran is the most preferable in view of preservability, productivity, and coating properties of coating liquids such as evenness of thickness of the resultant charge transport layer.

However, tetrahydrofuran is easily oxidized and thereby explosive peroxides are generated. Therefore, a small amount of a phenolic antioxidant is typically included in tetrahydrofuran to prevent the oxidation reaction,.

It is found by the present inventors that when tetrahydrofuran including such a phenolic antioxidant is used to form a charge transport layer and in addition a protective layer including a filler is formed thereon, a problem occurs such that the potential in the lighted area of the resultant photoreceptor increases when the photoreceptor is repeatedly used.

Because of these reasons, a need exists for a photoreceptor which can produce images having good image qualities while having a long life and high reliability and which is friendly to the environment.

SUMMARY OF THE INVENTION

Accordingly, an object of the present invention is to provide a photoreceptor which can produce images having good image qualities while having a long life and high reliability and which is friendly to the environment.

Another object of the present invention is to provide an image forming method and apparatus in which images having good image qualities are stably produced for a long period of time.

Briefly these objects and other objects of the present invention as hereinafter will become more readily apparent can be attained by an electrophotographic photoreceptor including an electroconductive substrate, a charge generation layer overlying the substrate, a charge transport layer formed overlying the substrate and including a charge transport material, a polycarbonate resin, an antioxidant having the following formula (1):

(1)

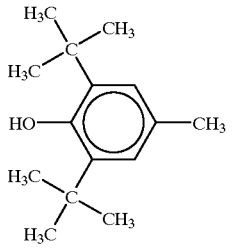

and a sulfur-containing compound having an alkyl group having from 6 to 30 carbon atoms, and a protective layer formed as a top layer and including a binder resin and a filler dispersed in the binder resin. The sulfur-containing compound is one having an alkyl group containing 6 to 30 carbon atoms. Preferably the sulfur-containing compound has the following formula (2):

(2)

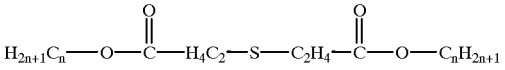

wherein n is an integer of from 6 to 30.

The photoreceptor may further include an undercoat layer on the substrate. Preferably the charge generation layer is formed on the undercoat layer and the charge transport layer is formed on the charge generation layer.

The total thickness D of the charge transport layer and the protective layer is preferably from 10 $\mu$m to 30 $\mu$m, and more preferably from 10 $\mu$m to 26 $\mu$m.

The charge transport layer is preferably formed by coating a coating liquid including tetrahydrofuran, the charge transport material, the polycarbonate resin, the antioxidant having formula (1) and the sulfur-containing compound. In addition, the charge transport layer may further include tetrahydrofuran.

In another aspect of the present invention, an image forming method is provided which includes the steps of charging a photoreceptor such that the photoreceptor has a surface potential V; imagewise irradiating the photoreceptor with a light beam to form an electrostatic latent image thereon, wherein the photoreceptor is the photoreceptor mentioned above, and wherein the image forming method satisfies the following relationship:

$$12 \leqq V/D \leqq 40$$

wherein V represents the surface potential of the photoreceptor in a unit of volt; and D represents the total thickness of the charge transport layer and protective layer in a unit of micrometer.

The diameter of the light beam is preferably not greater than 60 $\mu$m.

In yet another aspect of the present invention, an image forming apparatus is provided which includes at least a photoreceptor, a charger, a light irradiator, and an image developer, wherein the photoreceptor is the photoreceptor of the present invention and wherein the charger is a contact charger in which the charging element charges the photoreceptor while contacting the photoreceptor or a short-range charger in which the charging element charges the photoreceptor while the charging element is arranged closely to the photoreceptor.

The charging element preferably applies a DC voltage overlapped with an AC voltage to the photoreceptor when charging the photoreceptor.

In a further aspect of the present invention, a process cartridge is provided which includes at least a housing and a photoreceptor, wherein the photoreceptor is the photoreceptor of the present invention.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
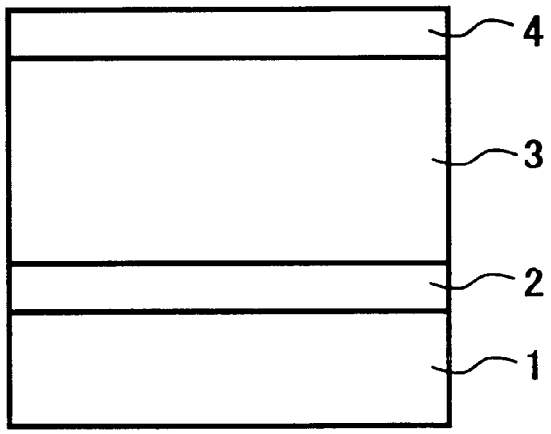
FIG. 1 is a schematic view illustrating the cross section of an embodiment of the photoreceptor of the present invention.

Generally, the present invention provides an electrophotographic photoreceptor including an electroconductive substrate; a charge generation layer overlying the substrate; a charge transport layer overlying the substrate and including a charge transport material, a polycarbonate resin, an antioxidant having the following formula (1):

(1)

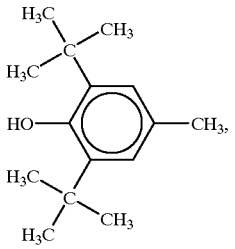

and a sulfur-containing compound having an alkyl group having from 6 to 30 carbon atoms; and a protective layer formed as a top layer and including a binder resin and a filler dispersed in the binder resin and, wherein the charge transport layer is formed by coating a coating liquid including tetrahydrofuran, the charge transport material, the polycarbonate resin, the antioxidant and the sulfur-containing compound.

The sulfur-containing compound is one having an alkyl group containing 6 to 30 carbon atoms. Preferably the sulfur-containing compound has the following formula (2):

(2)

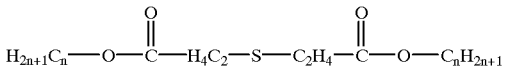

wherein n is an integer of from 6 to 30.

At this point, the term "overlying" means above and can also include, but dies not require, in contact with.

Tetrahydrofuran, which is typically included in a charge transport layer coating liquid used for forming the charge transport layer, is easily oxidized, and explosive peroxides are generated. Therefore, an antioxidant having formula (1) is typically included in tetrahydrofuran in an amount of about 250 ppm to prevent the oxidation reaction. The antioxidant is considered to serve as a radical terminator. Tetrahydrofuran having no antioxidant is marketed, but it is difficult to use such tetrahydrofuran in view of preservability of the coating liquid and manufacturing cost. Namely it has explosion risk and a high cost.

On the other hand, a need exists for a photoreceptor having good abrasion resistance. In order to improve the abrasion resistance, photoreceptor in which a protective layer including a resin and a filler dispersed in the resin is formed on a photosensitive layer have been proposed. Since the abrasion of photoreceptors are reduced, a need exists for a photoreceptor having better charge stability than ever. Namely a need exists for a photoreceptor which can be stably charged to a potential in a predetermined range even when repeatedly used for a long period of time.

It is found by the present inventors that when tetrahydrofuran including such an antioxidant having formula (1) is used to form a charge transport layer, a problem occurs such that the potential of the lighted area of the resultant photoreceptor gradually increases when the photoreceptor is repeatedly used. The reason is considered by the present inventors to be that the increase of the potential of the lighted area is caused by reaction products formed by reactions of the antioxidant with one or more of compounds generated in the image forming apparatus and/or compounds used in the elements of the image forming apparatus.

The present inventors discover that the increase of the potential of the lighted area can be improved by adding an agent having formula (2). One of the function of this agent is considered to make the reaction products (peroxides) inactive. The agent having formula (2) is preferably included in the charge transport layer in an amount of from 1 to 20 times the amount of the antioxidant having formula (1) included in the charge transport layer coating liquid.

In the present invention, the total thickness D of the charge transport layer and the protective layer is preferably from 10 $\mu$m to 30 $\mu$m, and more preferably from 10 $\mu$m to 26 $\mu$m to produce images having high image density and good reproducibility of fine line images and fine dot images.

The present inventors discover that when the photoreceptor of the present invention is used for reverse development in which toner particles adhere to lighted areas of the photoreceptor, undesired images such as background development (i.e., background fouling) can be avoided if the following relationship is satisfied:

$$12 \leqq V/D \leqq 40 \ (V/\mu m)$$

wherein D represents the total thickness of the charge transport layer and the protective layer of the photoreceptor in a unit of micrometer; and V represents the surface potential of the photoreceptor in a unit of volt. At this point, V/D means the strength of the electric field formed on the photoreceptor.

When the electric field strength (V/D) is too large, undesired images such as background fouling tend to be formed independently of the thickness of the photosensitive layer or the protective layer. In addition, when the charging process is performed using a contact charger, electric breakdown tends to occur in the photosensitive layer of the photoreceptor, resulting in formation of undesired images such as black spots or white spots.

To the contrary, when the electric field strength is too low, the charge transport ability of the photosensitive layer deteriorates, resulting in deterioration of the photosensitivity of the photoreceptor. Therefore the potential of the lighted area tends to increase, resulting in decrease of image density of the resultant images.

In the image forming method of the present invention, an electrostatic latent image is formed on the photoreceptor by irradiating a laser beam while putting on and off the laser beam according to the image information. Namely, a latent image in digital dot form is formed on the photoreceptor.

The diameter of the laser beam is preferably not greater than 60 $\mu$m to produce images having high resolution (i.e., images having good fine dot reproducibility). At this point, when the intensity of the laser beam is considered to be in accordance with a gaussian curve, the diameter (d) of the laser beam is defined as follows:

$$d = Wh \times (1/e^2)$$

wherein Wh represents a half width of the gaussian curve.

In the image forming apparatus of the present invention, a contact charger which charges a photoreceptor while a charging element of the charger contacts the photoreceptor, or a short-range charger which charge a photoreceptor while a charging element is arranged closely to the photoreceptor is preferably used. In the short-range charger, the gap between the charging element and the photoreceptor is preferably not greater than 100 $\mu$m. By using such chargers, generation of ozone and NOx, which not only smell but also cause blurring in the resultant images, can be decreased. In addition, by charging the photoreceptor of the present invention while applying a DC voltage overlapped with an AC voltage, the photoreceptor can be uniformly charged, resulting in prevention of uneven images.

The photoreceptor of the present invention will be explained referring to drawings.

FIG. 1 is a schematic view illustrating the cross section of an embodiment of the photoreceptor of the present invention.

In FIG. 1, a charge generation layer 2, a charge transport layer 3 and a protective layer 4 are formed on an electroconductive substrate 1 in this order.

Figure 2:
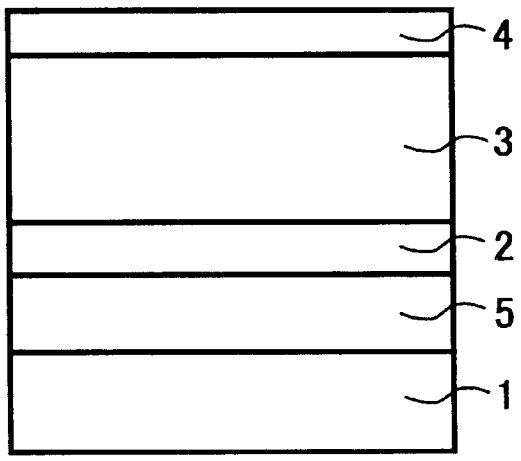
FIG. 2 is a schematic view illustrating cross section of another embodiment of the photoreceptor of the present invention.

FIG. 2 is a schematic view illustrating the cross section of another embodiment of the photoreceptor of the present invention.

In FIG. 2, an undercoat layer 5, a charge generation layer 2, a charge transport layer 3 and a protective layer 4 are formed on an electroconductive substrate 1 in this order.

The structure of the photoreceptor of the present invention is not limited thereto, and any construction is available if the photoreceptor has a charge generation layer, a charge transport layer, and a protective layer which is the top layer.

Suitable materials for use as the substrate 1 include a cylinder, a plate or a belt made of a metal such as Al, Fe, Cu, and Au or a metal alloy thereof. In addition, materials in which a thin layer of a metal such as Al, Ag and Au or a conductive material such as $In_2O_3$ and $SnO_2$ is formed on an insulating drum or film substrate such as polyester resins, polycarbonate resins, polyimide resins, and glass can also be used. Further, paper which is subjected to electroconductive treatment can be used as the substrate 1. The materials and shapes of the substrate 1 are not limited thereto.

In the photoreceptor of the present invention, the undercoat layer 5 is formed between the electroconductive substrate 1 and the photosensitive layer (i.e., a combination of the charge generation layer 2 and charge transport layer 3), for example, to improve the adhesion of the photosensitive layer to the substrate 1, to prevent moire in the resultant image, to improve the coating quality of the upper layer (i.e., to form a uniform photosensitive layer of the charge generation layer 2), and to decrease the residual potential of the resultant photoreceptor.

The undercoat layer 5 mainly includes a resin. Since a photosensitive layer coating liquid, which typically includes an organic solvent, is coated on the undercoat layer, the resin used in the undercoat layer preferably has good resistance to popular organic solvents.

Specific examples of such resins for use in the undercoat layer include water-soluble resins such as polyvinyl alcohol, casein and sodium polyacrylate; alcohol-soluble resins such as nylon copolymers, and methoxymethylated nylons; and crosslinkable resins, which form a three dimensional network, such as polyurethane resins, melamine resins, alkyd-melamine resins, and epoxy resins.

In addition, the undercoat layer 5 may include a fine powder such as metal oxides (e.g., titanium oxide, silica, alumina, zirconium oxide, tin oxide, and indium oxide), metal sulfides, and metal nitrides. When the undercoat layer 5 is formed using these materials, known coating methods using a proper solvent can be used.

In addition, a metal oxide layer which is formed, for example, by a sol-gel method using a silane coupling agent, titanium coupling agent or a chromium coupling agent can also be used as the undercoat layer.

Further, a layer of aluminum oxide which is formed by an anodic oxidation method, and a layer of an organic compound such as polyparaxylylene or an inorganic compound such as SiO, $SnO_2$, $TiO_2$, ITO or $CeO_2$, which is formed by a vacuum evaporation method, can also be preferably used as the undercoat layer.

The thickness of the undercoat layer 5 is preferably from 0 to 5 $\mu$m.

Next, the photosensitive layer will be explained.

In the photosensitive layer, a photosensitive material such as organic photoconductive materials (i.e., OPCs) can be used. The photoreceptor having a charge generation layer and a charge transport layer will be explained in detail.

At first, the charge generation 2 layer will be explained. The charge generation layer 2 is mainly constituted of a charge generation material, and optionally includes a binder resin. Suitable charge generation materials include inorganic charge generation materials and organic charge generation materials.

Specific examples of the inorganic charge generation materials include crystalline selenium, amorphous selenium, selenium-tellurium alloys, selenium-tellurium-halogen alloys, selenium-arsenic alloys and amorphous silicon. Suitable amorphous silicon includes ones in which a dangling bond is terminated with a hydrogen atom or a halogen atom, or in which a boron atom or a phosphorus atom is doped.

Specific examples of the organic charge generation materials include phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials.

These charge transport materials can be used alone or in combination.

Specific examples of the binder resin for use in the charge generation layer 2, which is optionally used in the charge generation layer 2, include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination.

One or more charge transport materials may be included in the charge generation layer 2, if desired. In addition, one or more charge transport polymer materials can be used as a binder resin of the charge generation layer 2.

Suitable methods for forming the charge generation layer 2 include thin film forming methods in a vacuum, and casting methods.

Specific examples of such thin film forming methods in a vacuum include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods useful for forming the charge generation layer 2 include, for example, the following steps:

(1) preparing a coating liquid by mixing one or more inorganic or organic charge generation materials mentioned above with a solvent such as tetrahydrofuran, cyclohexanone, dioxane, dichloroethane, butanone and the like, and if necessary, together with a binder resin and an additive, and then dispersing the materials with a ball mill, an attritor, a sand mill or the like;

(2) coating on a substrate the coating liquid, which is diluted if necessary, by a dip coating method, a spray coating method, a bead coating method, or the like method; and (3) drying the coated liquid to form a charge generation layer.

The thickness of the charge generation layer 2 is preferably from about 0.01 to about 5 $\mu$m, and more preferably from about 0.05 to about 2 $\mu$m.

Next, the charge transport layer 3 will be explained in detail.

The function of the charge transport layer 3 is to retain charges formed on the photosensitive layer, and to transport the carriers, which are selectively generated in the charge generation layer 2 by irradiating the photosensitive layer with imagewise light, to couple the carriers with the charges on the photosensitive layer, resulting in formation of an electrostatic latent image on the surface of the photoreceptor. Therefore, the charge transport layer 3 preferably has a high electric resistance to retain charges, and a small dielectric constant and large charge mobility to obtain a high surface potential at the charges retained on the photosensitive layer.

In order to satisfy such requirements, the charge transport layer is mainly constituted of a charge transport material together with a binder resin (polycarbonate resin) The charge transport layer 3 is typically prepared as follows:

(1) a charge transport material, a polycarbonate resin and an additive having formula 2 are dissolved or dispersed in tetrahydrofuran including an antioxidant having formula (1) to prepare a coating liquid; and (2) coating the coating liquid, for example, on the charge generation layer and then drying the coated liquid, resulting in formation of a charge transport layer 3.

The charge transport layer 3 may include a plasticizer, an antioxidant other than the antioxidant having formula 1, a leveling agent etc. in an amount such that these agents do not deteriorate the characteristics of the charge transport layer 3.

In addition, solvents which do not include a halogen atom can be added to the coating liquid. Specific examples of such solvents include dioxane, xylene, toluene, methyl ethyl ketone, cyclohexanone etc.

The charge transport materials are classified into positive hole transport materials and electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b] thiophene-4-one, 1,3,7-trinitrobenzothiophene-5, 5-dioxide, and the like compounds. These electron transport materials can be used alone or in combination.

Specific examples of the positive hole transport materials include electron donating materials such as oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, a-phenylstilbene derivatives, thiazole derivatives, triazole derivatives, phenazine derivatives, acridine derivatives, benzofuran derivatives, benzimidazole derivatives, thiophene derivatives, and the like materials. These positive hole transport materials can be used alone or in combination.

As the charge transport polymer material, the following charge transport polymers (i.e., polymers having an electron donating group) can be used:

(a) Polymers Having a Carbazole Ring in Their Main Chain and/or Side Chain

Specific examples of such polymers include poly-N-vinyl carbazole, and compounds disclosed in Japanese Laid-Open Patent Publications Nos. 50-82056, 54-9632, 54-11737, 4-175337, 4-183719 and 6-234841.

(b) Polymers Having a Hydrazone Skeleton in Their Main Chain and/or Side Chain

Specific examples of such polymers include compounds disclosed in Japanese Laid-Open Patent Publications Nos. 57-78402, 61-20953, 61-296358, 1-134456, 1-179164, 3-180851, 3-180852, 3-50555, 5-310904 and 6-234840.

(c) Polysilylene Compounds

Specific examples of such polymers include polysilylene compounds disclosed in Japanese Laid-Open Patent Publications Nos. 63-285552, 1-88461, 4-264130, 4-264131, 4-264132, 4-264133 and 4-289867.

(d) Polymers Having a Triaryl Amine Skeleton in Their Main Chain and/or Side Chain Specific examples of such polymers include N,N-bis(4-methylphenyl)-4-aminopolystyrene, and compounds disclosed in Japanese Laid-Open Patent Publications Nos. 1-134457, 2-282264, 2-304452, 4-133065, 4-133066, 5-40350.and 5-202135.

(e) Other Polymers

Specific examples of such polymers include condensation products of nitropyrene with formaldehyde, and compounds disclosed in Japanese Laid-Open Patent Publications Nos. 51-73888, 56-150749, 6-234836 and 6-234837.

The charge transport polymer material (the polymer having an electron donating group) for use in the charge transport layer 3 is not limited thereto, and known copolymers (random, block and graft copolymers) of the polymers with one or more known monomers and star polymers can also be used. In addition, crosslinking polymers having an electron donating group disclosed in, for example, Japanese Laid-Open Patent Publication No. 3-109406 can also be used.

Among these charge transport polymer materials, polycarbonates, polyurethanes, polyesters and polyethers, which have a triaryl amine structure are preferable. Specific examples of such polymer materials have been disclosed in Japanese Laid-Open Patent Publications Nos. 64-1728, 64-13061, 64-19049, 4-11627, 4-225014, 4-230767, 4-320420, 5-232727, 7-56374, 9-127713, 9-222740, 9-265197, 9-211877 and 9-304956.

Suitable polycarbonate resins include bisphenol A type, bisphenol Z type, bisphenol C type, bisphenol ZC type polycarbonate resins and the like. Polyacrbonate resins for use in the photosensitive layer are not limited thereto, and any polycarbonate resins having a bisphenol skeleton can be used. These polycarbonate resins can be used alone or in combination. In addition, these polycarbonate resins can be used in combination with resins other than polycarbonate resins.

The charge transport layer 3 may include an antioxidant other than the antioxidants having formula (1) mentioned above, and plasticizers which are used, for example, in rubbers, plastics, oils and fats.

In addition, the charge transport layer 3 may include a leveling agent. Specific examples of such leveling agents include silicone oils such as dimethyl silicone oils and methylphenyl silicone oils; and polymers and oligomers having a perfluoroalkyl group in their side chain. The content of the leveling agent is from 0 to 1 part by weight per 100 parts by weight of the binder resin included in the charge transport layer 3.

The charge transport layer 3 can be formed by a coating method such as dip coating, spray coating, and bead coating methods.

The thickness of the charge transport layer 3 is from 5 $\mu$m to 100 $\mu$m, and preferably from 10 $\mu$m to 22 $\mu$m.

The charge transport layer may further include a small amount of tetrahydrofuran.

Next, the protective layer 4 will be explained in detail.

Similarly to the charge transport layer 3, the function of the protective layer is also to transfer the charge carrier generated by the charge generation layer to the surface thereof to couple the charge carrier with the charge held on the surface thereof. In order to maintain the charge formed on the surface of the protective layer 4, the protective layer 4 preferably has a high resistance. In addition, in order to obtain high surface potential at the charge formed thereon, the protective layer preferably has a low dielectric constant and high charge mobility. Further, the protective layer 4 preferably has good abrasion resistance to impart good mechanical durability to the resultant photoreceptor.

The protective layer 4 mainly constituted of a binder resin and a filler dispersed in the binder resin.

Specific examples of the fillers include titanium oxide, silica, tin oxide, alumina, zirconium oxide, indium oxide, silicon nitride, calcium oxide, zinc oxide, barium sulfate, fluorine containing resins, and silicone resins. Among these fillers, titanium oxide, silica and zirconium oxide are preferable.

The surface of these fillers may be treated with one or more organic materials or inorganic materials to improve their dispersibility in the binder resin used. Specific examples of such organic materials include silane coupling agents, fluorine-containing silane coupling agents, and higher fatty acids. Specific examples of such inorganic materials include alumina, zirconia, tin oxide and silica.

The filler is dispersed in a binder resin optionally together with a low molecular weight charge transport material and/or a charge transport polymer material. Suitable binder resins include acrylic resins, polyester resins, polycarbonate resins, polyamide resins, polyurethane resins, polystyrene resins, and epoxy resins.

The content of the filler in the protective layer 4 is preferably from 5 to 50% by weight, and more preferably from 10 to 40% by weight of the protective layer 4. The thickness of the protective layer 4 is preferably from 1 to 7 $\mu$m. The total thickness of the charge transport layer 3 and the protective layer 4 is preferably from 10 $\mu$m to 30 $\mu$m, and more preferably from 10 $\mu$m to 26 $\mu$m.

The protective layer 4 can be formed by a coating method such as dip coating, spray coating and bead coating methods. Among these coating methods, spray coating methods are preferable because the layer on which the protective layer 4 is formed is not seriously dissolved, the thickness of the resultant protective layer 4 is uniform, and the surface of the resultant layer is smooth. In a typical spray coating method, mists of a coating liquid is projected from a nozzle having a fine opening to deposit the mists on the photosensitive layer (for example, on the charge transport layer 3).

The photoreceptor of the present invention can be used for typical electrophotographic image forming apparatus.

Next, a process cartridge including the photoreceptor of the present invention will be explained as an embodiment of the electrophotographic image forming apparatus.

The process cartridge of the present invention is a unit including at least a housing and the photoreceptor of the present invention. The process cartridge optionally includes one or more of a charger, an image developer, and a cleaner. The process cartridge can be easily attached to an image forming apparatus and detached therefrom.

Figure 3:
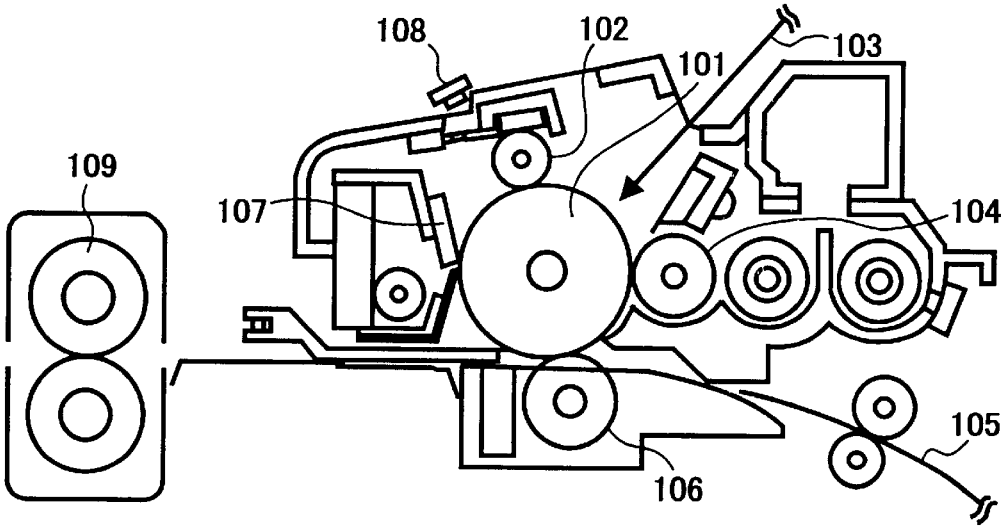
FIG. 3 is a schematic view illustrating an embodiment of the image forming apparatus (process cartridge) of the present invention and for explaining the image forming method of the present invention.

FIG. 3 is a schematic view illustrating an embodiment of the image forming apparatus of the present invention in which a process cartridge is installed. The image forming apparatus and method will be explained referring to FIG. 3.

In FIG. 3, a photoreceptor 101, which is the photoreceptor of the present invention, is charged with a charger having a charging roller 102. It is preferable that the charging roller 102 charges the photoreceptor 101 while contacting the photoreceptor 101 or arranged closely to the photoreceptor. In addition, it is preferable for the charging roller 102 to apply a DC voltage overlapped with an AC voltage to uniformly charge the photoreceptor 101.

After the photoreceptor 101 is charged, the photoreceptor 101 is exposed to imagewise light 103. At the lighted area of the photoreceptor 101, charges are generated and therefore an electrostatic latent image is formed on the surface of the photoreceptor 101 as mentioned above. Then the latent image is developed with a toner held on a developing roller 104 to form a toner image. The toner image formed on the surface of the photoreceptor 101 is transferred on a receiving material 105 such as paper by a transfer roller 106, and then fixed by a fixing unit 109. Thus, a hard copy is formed. The residual toner remaining on the photoreceptor 101 is removed by a cleaning unit 107. The residual charge remaining on the photoreceptor 101 is discharged by a discharge lamp 108. This image forming processes are repeated to produce the next image.

The image forming apparatus and method of the present invention are not limited thereto, and any image forming methods and apparatus including the processes, in which the photoreceptor of the present invention is charged and then exposed to imagewise light to form an electrostatic latent image, can be used.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Formation of Undercoat Layer

The following components were mixed to prepare an undercoat layer coating liquid.

| | |
|---|---|
| Alkyd resin (tradenamed as Bekkozol 1307-60-EL and manufactured by Dainippon Ink & Chemicals, Inc.) | 6 |
| Melamine resin (tradenamed as Super Bekkamin G-821-60 and manufactured by Dainippon Ink & Chemicals, Inc.) | 4 |
| Titanium oxide (tradenamed as CR-EL and manufactured by Ishihara Sangyo Kaisha, Ltd.) | 40 |
| Methyl ethyl ketone | 200 |

The undercoat layer coating liquid was coated on an aluminum cylinder having an outside diameter of 30 mm by a dip coating method, and then dried. Thus, an undercoat layer having a thickness of 3.5 μm was formed.

Formation of Charge Generation Layer

The following components were mixed to prepare a charge generation layer coating liquid.

| | |
|---|---|
| Oxotitanium phthalocyanine pigment | 5 |
| Polyvinyl butyral (tradenamed as XYHL and manufactured by Union Carbide Corp.) | 2 |
| Tetrahydrofuran | 80 |

The charge generation layer coating liquid was coated on the undercoat layer by a dip coating method and then heated to dry the coated liquid. Thus a charge generation layer was formed.

Formation of Charge Transport Layer

The following components were mixed to prepare a charge transport layer coating liquid.

| | |
|---|---|
| Bisphenol Z type polycarbonate | 10 |
| Low molecular weight charge transport material having the following formula (a) | 10 |

(a)

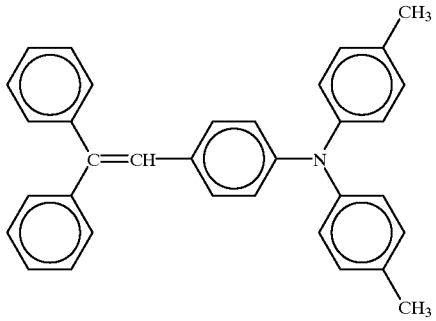

| | |
|---|---|
| Tetrahydrofuran (including an antioxidant having formula (1) in an amount of 250 ppm) | 100 |

-continued

| | |
|---|---|
| Peroxide decomposing agent having the following formula (2)-1 | 0.2 |
| $S(C_2H_4COOC_{18}H_{37})_2$ | (2)-1 |

The charge transport layer coating liquid was coated on the charge generation layer by a dip coating method, and then heated to dry the coated liquid. Thus, a charge transport layer having a thickness of 25 μm was formed.

Formation of Protective Layer

The following components were mixed to prepare a protective layer coating liquid.

| | |
|---|---|
| Bisphenol Z type polycarbonate resin | 10 |
| Low molecular weight charge transport material having following (a) | 10 |
| Titanium oxide (tradenamed as CR-97 and manufactured by Ishiahra Sangyo Kaisha, Ltd.) | 10 |
| Cyclohexanone | 130 |
| Tetrahydrofuran | 250 |

The protective layer coating liquid was coated on the charge transport layer by a spray coating method, and then heated to dry the coated liquid. Thus, a protective layer having a thickness of 3 μm was formed. The total thickness of the charge transport layer and the protective layer was 28 μm.

Thus, a photoreceptor of Example 1 was prepared.

Example 2

The procedure for preparation of the photoreceptor in Example 1 was repeated except that the thickness of the charge transport layer was changed to 22 μm (the total thickness was 25 μm).

Thus, a photoreceptor of Example 2 was prepared.

Example 3

The procedure for preparation of the photoreceptor in Example 1 was repeated except that the thickness of the charge transport layer was changed to 16 μm (the total thickness was 19 μm).

Thus, a photoreceptor of Example 3 was prepared.

Example 4

The procedure for preparation of the photoreceptor in Example 1 was repeated except that the thickness of the charge transport layer was changed to 10 μm (the total thickness was 13 μm).

Thus, a photoreceptor of Example 4 was prepared.

Example 5

The procedure for preparation of the photoreceptor in Example 1 was repeated except that the thickness of the charge transport layer was changed to 6 μm (the total thickness was 9 μm).

Thus, a photoreceptor of Example 5 was prepared.

Example 6

The procedure for preparation of the photoreceptor in Example 1 was repeated except that the thickness of the charge transport layer was changed to 29 μm (the total thickness was 32 μm).

Thus, a photoreceptor of Example 6 was prepared.

Example 7

The procedure for preparation of the photoreceptor in Example 1 was repeated except that the thickness of the charge transport layer was changed to 13 μm (the total thickness was 16 μm).

Thus, a photoreceptor of Example 7 was prepared.

Comparative Example 1

The procedure for preparation of the photoreceptor in Example 1 was repeated except that the peroxide decomposing agent was removed from the charge transport layer coating liquid.

Thus, a photoreceptor of Comparative Example 1 was prepared.

Comparative Example 2

The procedure for preparation of the photoreceptor in Example 1 was repeated except that the solvent (i.e., tetrahydrofuran including an antioxidant having formula (1)) was replaced with 100 parts by weight of dioxane.

Thus, a photoreceptor of Comparative Example 2 was prepared.

Comparative Example 3

The procedure for preparation of the photoreceptor in Example 1 was repeated except that the solvent (i.e., tetrahydrofuran including an antioxidant having formula (1)) was replaced with 100 parts by weight of xylene.

Thus, a photoreceptor of Comparative Example 3 was prepared.

Evaluation 1

Each of the photoreceptors of Examples 1 to 7 and Comparative Examples 1 to 3 was evaluated by setting the photoreceptor in a copier (which is modified Imagio MF2200 manufactured by Ricoh Co., Ltd. and whose construction is similar to that shown in FIG. 3) and performing a running test in which 100,000 copies were produced. At the beginning and end of the running test, the potential (Vd) of the dark area and the potential (Vl) of the lighted area of each of the photoreceptors were measured. The DC bias applied to the photoreceptors was changed from −1450 to −1600 V to control the initial potential of the dark area thereof so as to be −600V.

The results are shown in Table 1.

TABLE 1

| | Vd (-V) | | Vl (-V) | |
|---|---|---|---|---|
| | Beginning | End | Beginning | End |
| Ex. 1 | 600 | 605 | 140 | 150 |
| Ex. 2 | 600 | 600 | 130 | 130 |
| Ex. 3 | 600 | 600 | 125 | 120 |
| Ex. 4 | 600 | 590 | 110 | 95 |
| Ex. 5 | 600 | 585 | 100 | 95 |
| Ex. 6 | 600 | 605 | 140 | 155 |
| Ex. 7 | 600 | 590 | 120 | 120 |
| Comp. Ex. 1 | 600 | 605 | 145 | 280 |
| Comp. Ex. 2 | 600 | 620 | 135 | 250 |
| Comp. Ex. 3 | 600 | 610 | 140 | 245 |

Evaluation 2

Each of the photoreceptors of Examples 1 to 6 was evaluated by setting the photoreceptor in a copier (modified Imagio MF2200 manufactured by Ricoh Co., Ltd.) and performing a running test in which 80,000 copies were produced. After the running test, the abrasion of the photosensitive layer of each photoreceptor was determined. In addition, image qualities of the produced images were evaluated by the following methods at the beginning and end of the running test. The DC bias applied to the photoreceptors was changed from −1450 to −1600 V to control the initial potential of the dark area thereof so as to be −600V.

Background Development

The white images were visually observed to determine whether there is fouling on the white area. The fouling was classified into the following three grades.

3: Background fouling is not observed.

2: Slight background fouling is observed but it is still acceptable.

1: Background fouling is observed over the entire background.

Reproducibility of Fine Dots

The dot image in which dots were arranged in the vertical and horizontal directions at a density of 600 dpi was visually observed optionally using a microscope. The dot reproducibility was classified into the following three grades.

3: Good

2: Reproducibility of part of the dot image slightly deteriorates. (Some dots are widened)

1: Reproducibility of the entire dot image deteriorates due to toner scattering.

Reproducibility of Fine Lines

The line image in which one dot lines were arranged in the vertical and horizontal directions at a line density of 200 lpi and dot density of 1200 dpi was visually observed optionally using a microscope. The fine reproducibility was classified into the following three grades.

3: Good

2: Reproducibility of part of the line image slightly deteriorates. (Some dots are widened)

1: Reproducibility of the entire line image deteriorates due to toner scattering.

The results are shown in Table 2.

TABLE 2

| | Abrasion | Background development | | Dot reproducibility | | Line reproducibility | |
|---|---|---|---|---|---|---|---|
| | (μm) | Beginning | End | Beginning | End | Beginning | End |
| Ex. 1 | 1.25 | 3 | 3 | 2 | 3 | 1 | 2 |
| Ex. 2 | 1.26 | 3 | 3 | 3 | 3 | 3 | 3 |
| Ex. 3 | 1.34 | 3 | 3 | 3 | 3 | 3 | 3 |
| Ex. 4 | 1.28 | 3 | 2 | 3 | 3 | 3 | 3 |
| Ex. 5 | 1.22 | 3 | 1 | 3 | 3 | 3 | 3 |
| Ex. 6 | 1.31 | 3 | 3 | 1 | 1 | 1 | 1 |

Evaluation 3

Each of the photoreceptors of Examples 6 and 7 was evaluated by setting the photoreceptor in a copier (modified Imagio MF2200 manufactured by Ricoh Co., Ltd.) and performing a running test in which 100, 000 copies were produced at three levels of surface potential of −1000, −600 or −350 V. The abrasion and background development were also evaluated in the same way as mentioned above.

The results are shown in Table 3.

TABLE 3

| | Beginning | | | | End | | | |
|---|---|---|---|---|---|---|---|---|
| | Vd (-V) | D (μm) *1 | EFS (V/μm) *2 | BD *3 | Vd (-V) | D (μm) *1 | EFS (V/μm) *2 | BD *3 |
| Ex. 6 | 1000 | 32 | 31.3 | 3 | 1000 | 30.2 | 33.11 26 | 3 |
| | 600 | 32 | 18.8 | 3 | 600 | 30.5 | 19.67 21 | 3 |
| | 350 | 32 | 10.9 | 3 | 350 | 30.8 | 11.36 36 | 3 |
| Ex. 7 | 1000 | 16 | 62.5 | 1 | — (*4) | — | — | — |
| | 600 | 16 | 37.5 | 3 | 600 | 14.1 | 42.55 32 | 2 |
| | 350 | 16 | 21.9 | 3 | 350 | 14.3 | 24.47 55 | 3 |

*1 Total thickness of the charge transport layer and the protective layer
*2 Strength of electric field applied to the photoreceptor (i.e., Vd/D)
*3 Background development
*4 The photoreceptor could not be charged.

In addition, when the potential (Vd) of the photoreceptor of Example 6 was −350 V, the lines and dots of the image were widened.

Evaluation 4

The photoreceptor of Example 3 was evaluated by setting the photoreceptor in the modified Imagio MF2200 to perform a running test in which 70, 000 copies were produced while changing the diameter (Φ) of the laser beam spot from 40 to 90 μm. The total thickness (D) of the charge transport layer and the protective layer was measured before and after the running test. In addition, dot reproducibility of the resultant images was evaluated. The initial potential of the dark area was set so as to be −600 V.

The results are shown in Table 4.

TABLE 4

| D (μm) | | | | | |
|---|---|---|---|---|---|
| Before running test | After running test | Vd (-V) | Φ (μm) | Dot reproducibility *1 Beginning | Dot reproducibility *1 End |
| 19 | 17.8 | 600 | 90 | 1 | 1 |
| | | | 65 | 1 | 2 |
| | | | 55 | 3 | 3 |
| | | | 40 | 3 | 3 |

*1 The dot image in which dots were arranged in the vertical and horizontal directions at a density of 1200 dpi was observed using a microscope. The dot reproducibility was classified into the following three grades.
3: Good
2: Reproducibility of part of the dot image slightly deteriorates.
1: Reproducibility of the entire dot image deteriorates due to toner scattering.

Example 8

The procedures for preparation and evaluation 1 of the photoreceptor of Example 1 were repeated except that a gap of 50 μm was formed between the charging roller and the photoreceptor by adhering an insulation tape having a thickness of 50 μm and a width of 5 mm on both sides of the charging roller. Namely a short-range charging was performed.

As a result, the surface of the charging roller was not dirtied although the surface of the charging roller was slightly dirtied when the contact charging was performed in Evaluation 1. In addition, the image qualities were good at the beginning and end of the running test. However, when half-tone images were produced after the running test, the density of the half-tone images was slightly uneven due to uneven charging.

Example 9

The procedures for preparation and evaluation of the photoreceptor in Example 8 were repeated except that the DC bias was changed to an AC overlapped DC bias when charging the photoreceptor. The charging conditions are as follows:

DC bias: −1520 V

AC bias: 2.0 kV (peak-to-peak voltage)

2 kHz (frequency)

As a result, the image qualities were good even after the running test. The soil of the charging roller which was observed in Example 1 and the uneven half-tone images observed in Example 8 were not observed.

As can be understood from the above-description, by adding a peroxide decomposing agent having formula (2) in the charge transport layer of the present invention, which is formed by coating a coating liquid including tetrahydrofuran including an antioxidant having formula (1), the resultant photoreceptor can be stably charged so as to have a potential in a preferable range even when used for a long period of time.

In addition, when the total thickness of the charge transport layer and the protective layer is from 10 to 30 μm, and preferably from 10 to 26 μm, images having good image qualities can be obtained.

Further occurrence of undesired images such as background development can be reduced when the following relationship is satisfied:

$$12 \leqq V/D \leqq 40 \ (V/\mu m)$$

wherein V represents the potential (absolute value) of the charged photoreceptor, and D represents the total thickness of the charge transport layer and the protective layer.

Furthermore, when the diameter of the laser beam in the image forming apparatus of the present invention, which is used for scanning the photoreceptor to form an electrostatic latent image, is not greater than 60 μm, the resultant images have good dot reproducibility.

Furthermore, when a contact charging element or a short-range charging element is used for charging the photoreceptor of the present invention, generation of ozone and NOx can be reduced.

Furthermore, by applying an AC overlapped DC bias to the charging element to charge the photoreceptor, images having good evenness can be produced.

This document claims priority and contains subject matter related to Japanese Patent Applications Nos. 2000-103888 and 2001-047211, filed on Apr. 5, 2000, and Feb. 22, 2001, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor comprising:

an electroconductive substrate;

a charge generation layer overlying the substrate;

a charge transport layer formed overlying the substrate and comprising a charge transport material, a polycarbonate resin, an antioxidant having the following formula (1):

(1)

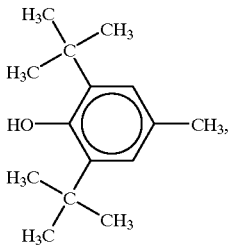

and a sulfur-containing compound having an alkyl group having from 6 to 30 carbon atoms; and a protective layer formed as a top layer and comprising a binder resin and a filler dispersed in the binder resin, wherein said charge transport layer is formed by coating a coating liquid comprising tetrahydrofuran, the charge transport material, the polycarbonate resin, the antioxidant and the sulfur-containing compound.

2. The electrophotographic photoreceptor according to claim 1, wherein the charge transport layer further comprises tetrahydrofuran.

3. The electrophotographic photoreceptor according to claim 1, wherein the sulfur-containing compound has the following formula (2):

(2)

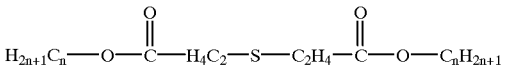

wherein n is an integer of from 6 to 30.

4. The electrophotographic photoreceptor according to claim 1, wherein a total thickness of the charge transport layer and the protective layer is from 10 μm to 30 μm.

5. The electrophotographic photoreceptor according to claim 4, wherein the total thickness of the charge transport layer and the protective layer is from 10 μm to 26 μm.

6. The electrophotographic photoreceptor according to claim 1, further comprising an undercoat layer on the electroconductive substrate, wherein the charge generation layer is formed on the undercoat layer and the charge transport layer is formed on the charge generation layer.

7. An image forming method comprising:

charging a photoreceptor such that the photoreceptor has a surface potential V; and irradiating the photoreceptor with a light beam to form an electrostatic latent image thereon, wherein the photoreceptor comprises:

an electroconductive substrate;

a charge generation layer overlying the substrate;

a charge transport layer formed overlying the substrate and comprising a charge transport material, a polycarbonate resin, an antioxidant having the following formula (1):

(1)

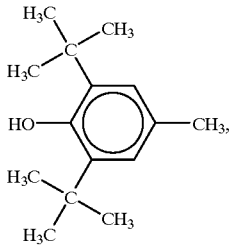

and a sulfur-containing compound having an alkyl group having from 6 to 30 carbon atoms; and a protective layer formed as a top layer and comprising a binder resin and a filler dispersed in the binder resin, and wherein the image forming method satisfies the following relationship:

$$12 \leqq V/D \leqq 40$$

wherein V represents the surface potential of the photoreceptor in units of volt; and D represents a total thickness of the charge transport layer and the protective layer in units of micrometer.

8. The image forming method according to claim 7, wherein the charge transport layer is formed by coating a coating liquid comprising tetrahydrofuran, the charge transport material, the polycarbonate resin, the antioxidant and the sulfur-containing compound.

9. The image forming method according to claim 8, wherein the charge transport layer further comprises tetrahydrofuran.

10. The image forming method according to claim 7, wherein the sulfur-containing compound has the following formula (2):

(2)

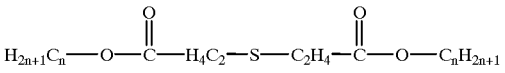

wherein n is an integer of from 6 to 30.

11. The image forming method according to claim 7, wherein the light beam has a diameter of not greater than 60 μm.

12. The image forming method according to claim 7, wherein the total thickness of the charge transport layer and the protective layer is from 10 to 30 μm.

13. The image forming method according to claim 12, wherein the total thickness of the charge transport layer and the protective layer is from 10 to 26 μm.

14. The image forming method according to claim 7, further comprising an undercoat layer on the electroconductive substrate, wherein the charge generation layer is formed on the undercoat layer and the charge transport layer is formed on the charge generation layer.

15. An image forming apparatus comprising:

a photoreceptor;

a charger configured to charge the photoreceptor with a charging element such that the photoreceptor has a surface potential V;

a light irradiator configured to irradiate the photoreceptor with a light beam to form an electrostatic latent image on the photoreceptor; and an image developer configured to develop the electrostatic latent image with a toner to form a toner image on the photoreceptor, wherein the photoreceptor comprises:

an electroconductive substrate;

a charge generation layer overlying the substrate;

a charge transport layer formed overlying the substrate and comprising a charge transport material, a polycarbonate resin, an antioxidant having the following formula (1):

(1)

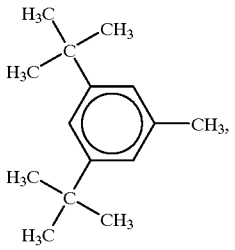

and a sulfur-containing compound having an alkyl group having from 6 to 30 carbon atoms; and a protective layer formed as a top layer and comprising a binder resin and a filler dispersed in the binder resin, wherein said charge transport layer is formed by coating a coating liquid comprising tetrahydrofuran, the charge transport material, the polycarbonate resin, the antioxidant and the sulfur-containing compound.

16. The image forming apparatus according to claim 15, wherein the charge transport layer further comprises tetrahydrofuran.

17. The image forming apparatus according to claim 15, wherein the sulfur-containing compound has the following formula (2):

(2)

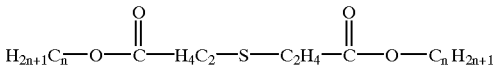

wherein n is an integer of from 6 to 30.

18. The image forming apparatus according to claim 15, wherein the charger is one of a contact charger and a short-range charger.

19. The image forming apparatus according to claim 15, wherein the charger charges the photoreceptor while the charging element applies a DC voltage overlapped with an AC voltage to the photoreceptor.

20. The image forming apparatus according to claim 15, wherein the image forming apparatus satisfies the following relationship:

$$12 \leqq V/D \leqq 40$$

wherein V represents the surface potential of the photoreceptor in units of volt when the photoreceptor is charged; and D represents a total thickness of the charge transport layer and the protective layer in units of micrometer.

21. The image forming apparatus according to claim 15, wherein the light beam has a diameter of not greater than 60 μm.

22. The image forming apparatus according to claim 15, wherein the total thickness of the charge transport layer and the protective layer is from 10 to 30 μm.

23. The image forming apparatus according to, claim 22, wherein the total thickness of the charge transport layer and the protective layer is from 10 to 26 μm.

24. The image forming apparatus according to claim 15, wherein the photoreceptor further comprises an undercoat layer on the electroconductive substrate, wherein the charge generation layer is formed on the undercoat layer and the charge transport layer is formed on the charge generation layer.

25. A process cartridge for an image forming apparatus, comprising:

a housing; and an electrophotographic photoreceptor comprising:

an electroconductive substrate;

a charge generation layer overlying the substrate;

a charge transport layer formed overlying the substrate and comprising a charge transport material, a polycarbonate resin, an antioxidant having the following formula (1):

(1)

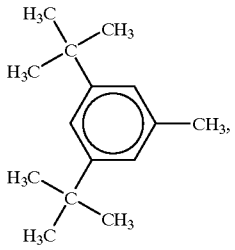

and a sulfur-containing compound having an alkyl group having from 6 to 30 carbon atoms; and a protective layer comprising a binder resin and a filler dispersed in the binder resin and formed as a top layer, wherein said charge transport layer is formed by coating a coating liquid comprising tetrahydrofuran, the charge transport material, the polycarbonate resin, the antioxidant and the sulfur-containing compound.

26. The process cartridge according to claim 25, wherein said charge transport layer further comprises tetrahydrofuran.

27. The process cartridge according to claim 25, wherein the sulfur-containing compound has the following formula (2):

(2)

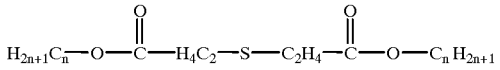

wherein n is an integer of from 6 to 30.

28. The process cartridge according to claim 25, wherein a total thickness of the charge transport layer and the protective layer is from 10 μm to 30 μm.

29. The process cartridge according to claim 28, wherein the total thickness of the charge transport layer and a thickness of the protective layer is from 10 μm to 26 μm.

30. The process cartridge according to claim 27, wherein the process cartridge further comprises an undercoat layer on the electroconductive substrate, wherein the charge generation layer is formed on the undercoat layer and the charge transport layer is formed on the charge generation layer.

* * * * *